US008025085B2

(12) United States Patent
Skaggs et al.

(10) Patent No.: US 8,025,085 B2
(45) Date of Patent: Sep. 27, 2011

(54) AUTOMATED VIAL LABELING APPARATUS

(75) Inventors: Michael Skaggs, Olathe, KS (US); Ronald A. Leonard, Peculiar, MO (US); Travis Putman, Gardner, KS (US); George Brown, Overland Park, KS (US)

(73) Assignee: ScriptPro LLC, Mission, KS (US)

( * ) Notice: Subject to any disclaimer, the term of this patent is extended or adjusted under 35 U.S.C. 154(b) by 235 days.

(21) Appl. No.: 12/360,199

(22) Filed: Jan. 27, 2009

(65) Prior Publication Data

US 2010/0186871 A1 Jul. 29, 2010

(51) Int. Cl.
*B65B 51/06* (2006.01)

(52) U.S. Cl. ..... 156/468; 156/556

(58) Field of Classification Search ..... 156/538, 156/468, 580, 539, DIG. 25, DIG. 26, DIG. 11
See application file for complete search history.

(56) References Cited

U.S. PATENT DOCUMENTS 3,206,347 A * 9/1965 Holstein ..... 156/476
5,021,116 A * 6/1991 Milgram et al. ..... 156/475
5,232,541 A * 8/1993 Gifford ..... 156/366
5,413,666 A * 5/1995 Orlandi ..... 156/566
5,798,020 A * 8/1998 Coughlin et al. ..... 156/542
6,206,590 B1 3/2001 Thomas et al.
6,578,734 B1 * 6/2003 Coughlin et al. ..... 221/219
2002/0080393 A1 6/2002 Leonard

* cited by examiner

*Primary Examiner* — Khanh P Nguyen
*Assistant Examiner* — Vishal I Patel
(74) *Attorney, Agent, or Firm* — Hovey Williams LLP

(57) ABSTRACT

An apparatus and method for applying a label to a specific location on a vial. The apparatus may comprise a label dispenser, a vial placement assembly for orienting the vial and placing it onto a track, a pushing device for pushing the vial down the track into an adhesive side of the label, and a labeling gate for contacting a non-adhesive side of the label to smooth the label onto the vial. The apparatus may further comprise a label positioning device for correcting unwanted curling of the label, a stopper positioned to engage a portion of the pushing device as the vial contacts the label to cause the pushing device to release the vial, and a label-release switch configured to signal for the label dispenser to release a trailing edge of the label once the vial contacts the labeling gate.

22 Claims, 12 Drawing Sheets

AUTOMATED VIAL LABELING APPARATUS

BACKGROUND

1. Field

The present invention relates to the field of automated medicament dispensing systems. More particularly, the invention relates to an automated apparatus and method for applying labels to vials.

2. Related Art

In the field of automated medicament dispensing systems, a vial is automatically filled with pills or other medicaments and presented without a label thereon to a pharmacist. A printer dispenses an adhesive label with the associated prescription or instructions thereon to the pharmacist for manual application of the label to the vial. When a plurality of orders are to be processed, filled vials are presented in sequence and the corresponding labels are dispensed in sequence.

Difficulties can arise, for example, if the printer malfunctions. In this situation, the sequence of reprinted labels can be confused leading to the risk of applying the wrong label to a vial. Similarly, if the vial filling mechanism malfunctions, the sequence of vials for labeling can also become confused, again leading to the risk of a mislabeled vial.

Automated medicine vial labelers have largely overcome these problems for cylindrical-shaped vials of various sizes. Such labelers generally wrap a label around a vial by placing an outer surface of the vial in contact with an adhesive side of the label and rotating the vial. However, in some instances, it is desirable to use non-cylindrical-shaped vials, such as vials with substantially oval cross-sections or rectangular cross-sections. These non-cylindrical-shaped vials may make the vial easily distinguishable from other vials, present a larger surface area for the label, etc. For example, some vials may have a front face, a back face, and two side faces. Unlike cylindrical-shaped vials, the location of the label on non-cylindrical-shaped vials is important, so that when each vial is facing the same direction, the same part of the label may be visible to the pharmacist or patient. Automated medicine vial labelers for cylindrical-shaped vials are unsuitable for non-cylindrical-shaped vials because they merely wrap the label around the vial without consideration for the orientation of a front, back, or side of the vial.

Accordingly, there is a need for an automated apparatus and method for labeling vials that overcomes the limits of the prior art.

SUMMARY

The present invention provides an apparatus and method for applying a label to a vial. The apparatus may be particularly configured to properly orient the vial such that the label may be applied at a specific location and/or on a specific side of the vial. An exemplary embodiment of the apparatus may comprise a label dispenser, a vial placement assembly, a pushing device, and a labeling gate. The apparatus may further comprise a track, a receiving surface, a label positioning device, a stopper, a label-release switch, and at least one controller.

The label dispenser may be any label dispenser operable to present a label between the stopper and the labeling gate with an adhesive side of the label facing the stopper, and a non-adhesive side of the label facing the labeling gate. The vial placement assembly may comprise a turntable for orienting the vial and a vial placement arm for moving the vial from a first location on the turntable to a second location on the track. The pushing device may be shaped to partially conform to a portion of the vial and may be configured and actuated to push the vial down the track from the second location to a third location, where the label is located, and then to a fourth location. The pushing device may comprise positioning arms biased to keep the vial centered on the track and cooperatively pivotal outward away from each other to release the vial.

The labeling gate may be positioned between the third location and the fourth location and may comprise two label smoothing arms, each having a label smoothing roller. The label smoothing arms may pivot outward and away from each other by a force applied to the label smoothing arms through the vial by the pushing device as the vial is moved from the third location to the fourth location. The label smoothing rollers may roll against the non-adhesive side of the label, smoothing the label against the vial, as the vial is moved from the third location to the fourth location.

The track guides the pushing device and may be configured to provide actuation to or allow actuation of the pushing device forward and aft along the track. The receiving surface may be adjacent the track for receiving the labeled vials and the fourth location may be located on the receiving surface. The label positioning device may be configured to flatten the label once it is dispensed from the label dispenser, to compensate for any curling of the label. The stopper may be positioned proximate the third location, between the third location and the second location, such that as the vial reaches the third location, the stopper may be engaged by one of the positioning arms, causing the positioning arms to pivot away from the vial as the pushing device pushes the vial from the third location to the fourth location.

The label-release switch may be positioned proximate to or integral with the labeling gate and may be configured to signal to the controller and/or the label dispenser to release or fully dispense a trailing edge of the label once the label smoothing arms begin to pivot. The controller may be any combination of processors, circuitry, etc. for commanding various actuators of the apparatus depending on timing and sequencing programmed into the controller, and/or the status of any or all of the various apparatus components. Additionally, the controller may be configured for receiving status signals from various switches and sensors of the apparatus.

An exemplary method for applying a label to a vial may comprise placing the vial on a turntable and actuating the turntable to turn by an amount such that the vial is in a desired orientation. The method may further comprise moving the vial from a first location on the turntable to a second location on a track, and then actuating a pushing device to move the vial from the second location to a third location and into contact with an adhesive side of the label. The label may be at least partially dispensed by a label dispenser and flattened by a label positioning device prior to the vial moving to the third location. The pushing device may then push the vial from the third location to a fourth location, thereby pressing the vial into the label and the label into a labeling gate for pressing and smoothing the label onto the vial. As the vial is pushed against the labeling gate, a trailing edge of the label may be released or fully dispensed from the label dispenser.

These and other important aspects of the present invention are described more fully in the detailed description below.

BRIEF DESCRIPTION OF THE DRAWINGS

Embodiments of the present invention are described in detail below with reference to the attached drawing figures, wherein.

Figure 1:
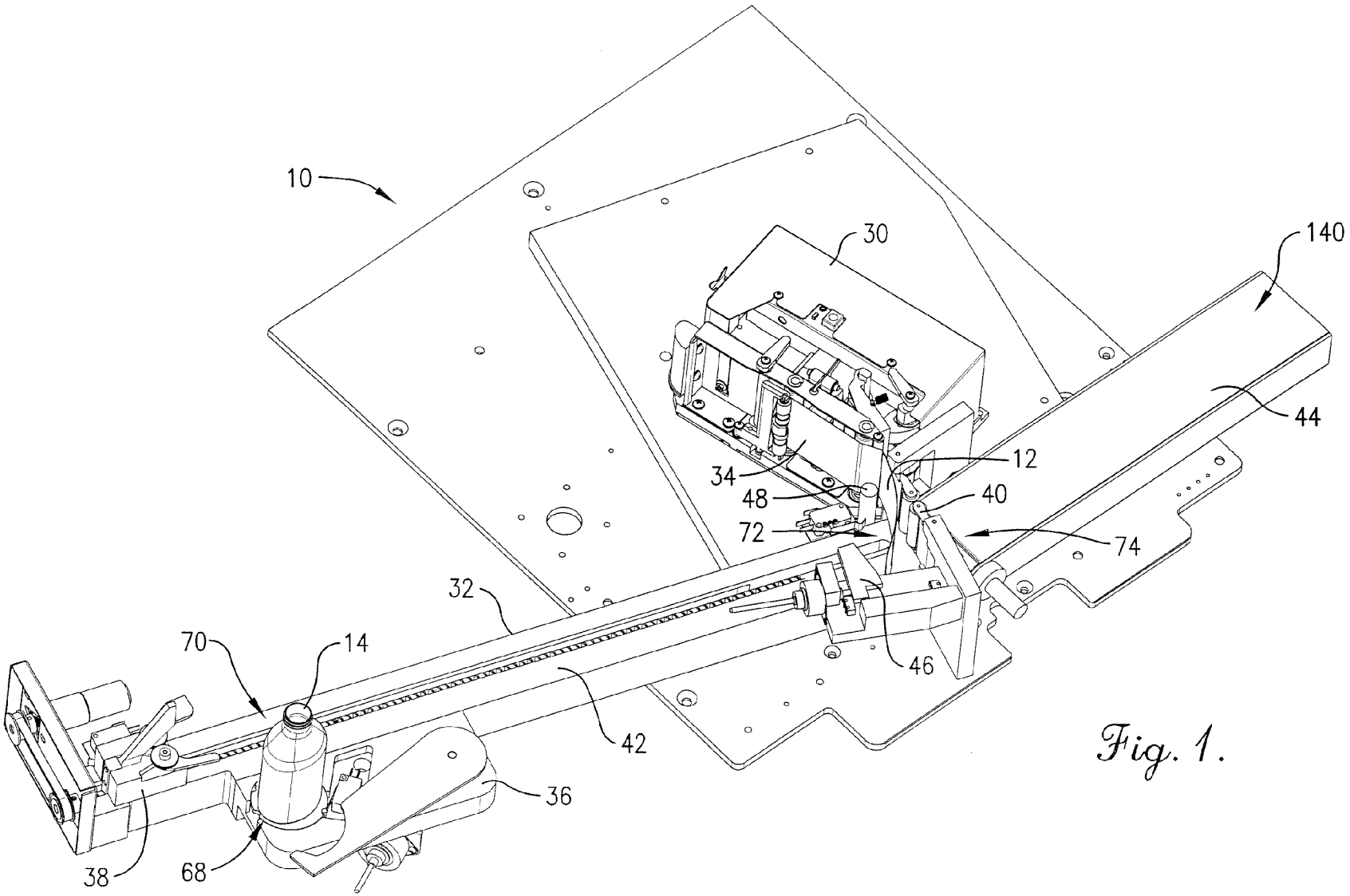
FIG. 1 is a perspective view of a vial labeler constructed in accordance with an embodiment of the present invention, with a vial positioned at a first location.

The drawing figure does not limit the present invention to the specific embodiments disclosed and described herein. The drawing is not necessarily to scale, emphasis instead being placed upon clearly illustrating the principles of the invention.

DETAILED DESCRIPTION

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

Figure 2:
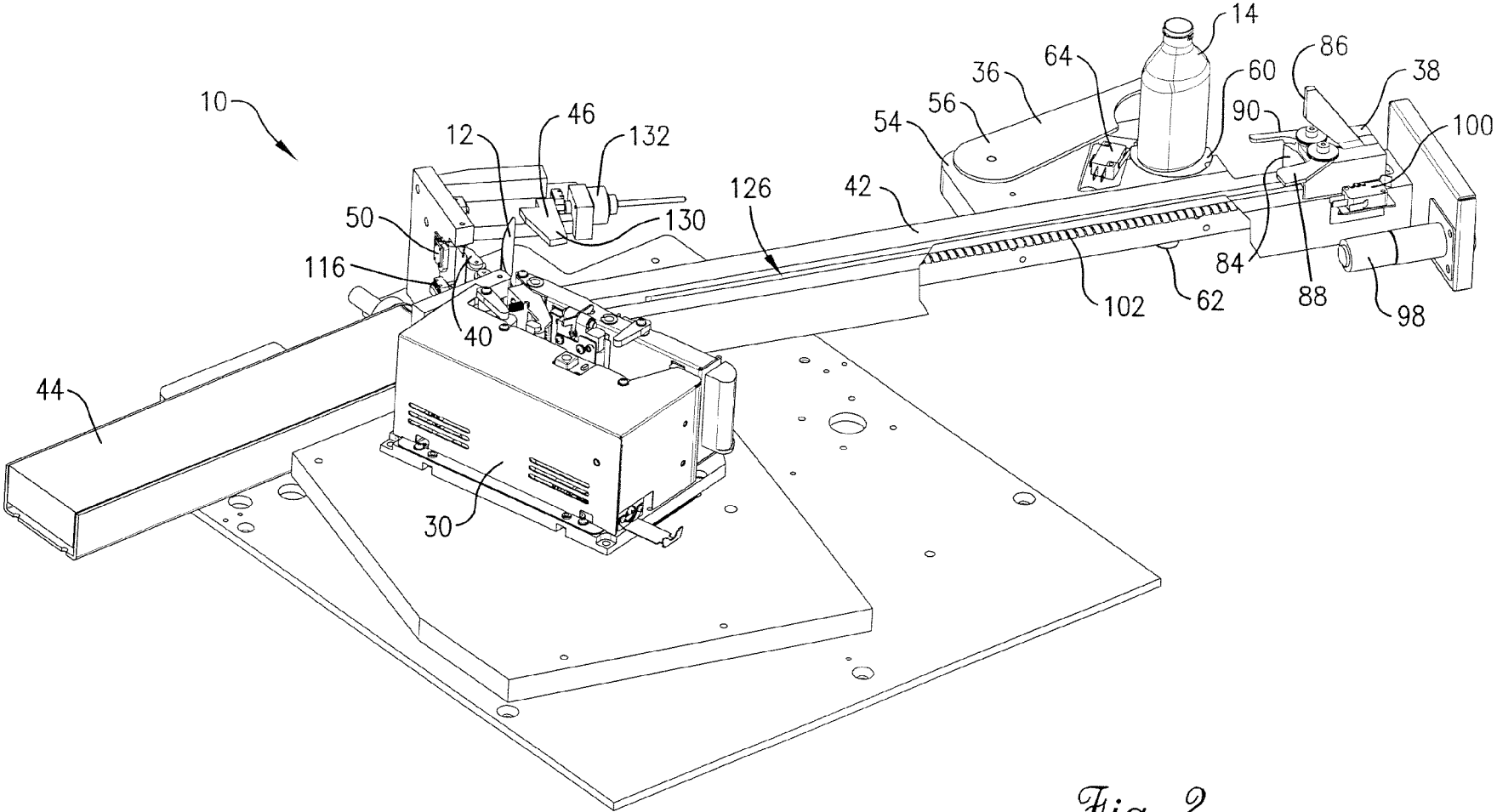
FIG. 2 is a perspective view of the vial labeler of FIG. 1 with a portion of a track broken away to illustrate a lead screw.
Figure 3:
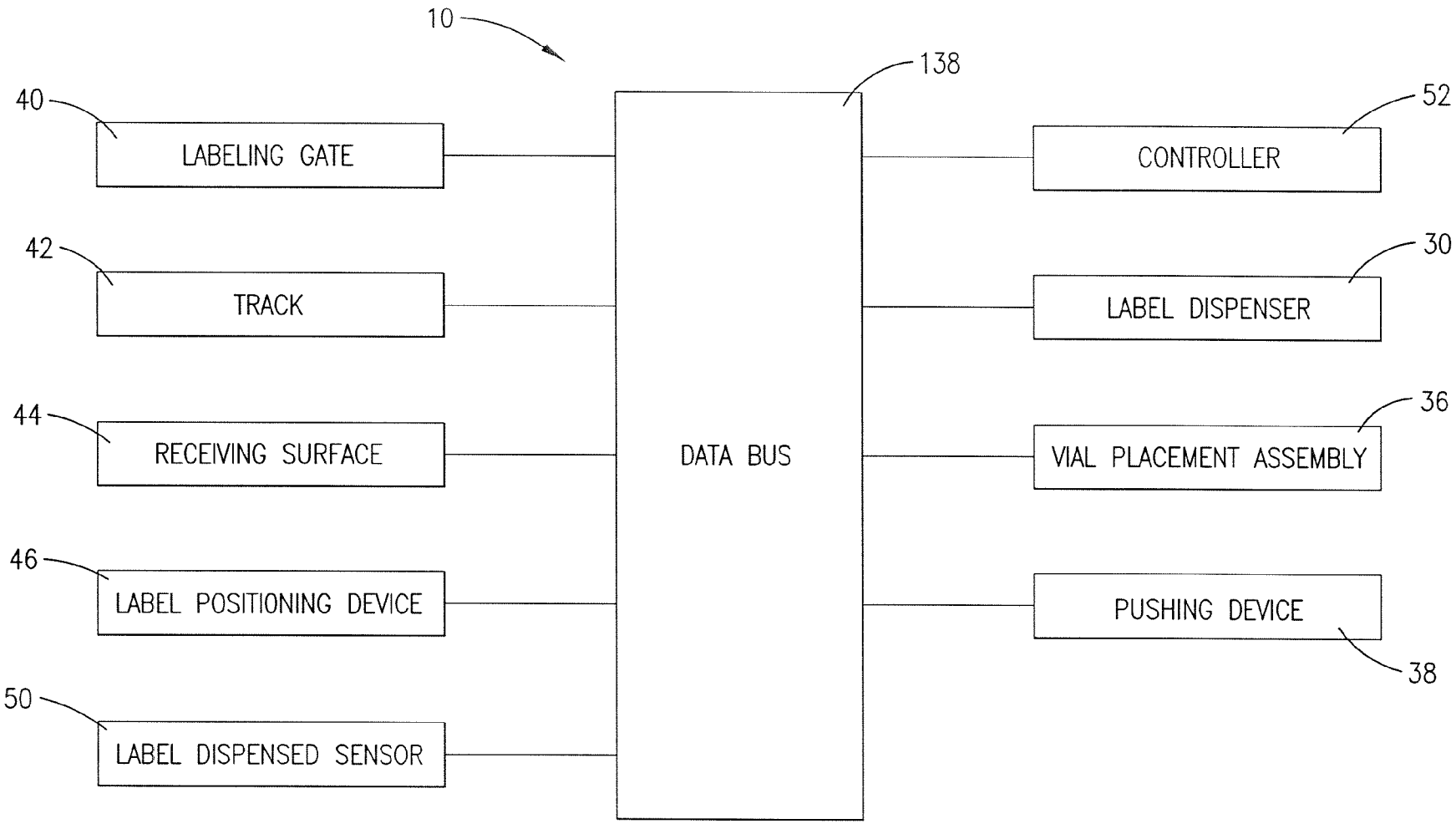
FIG. 3 is a block diagram illustrating selected components of the vial labeler including a controller.
Figure 4:
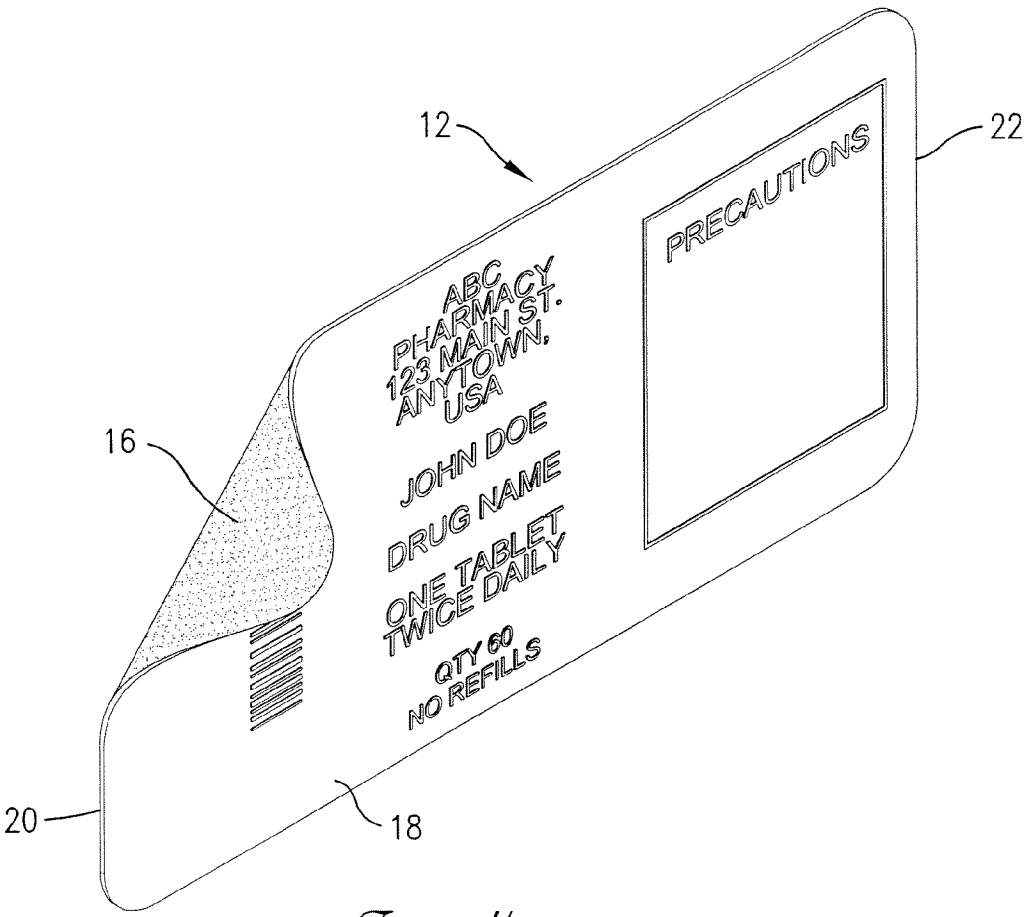
FIG. 4 is a perspective view of a label for placement on a vial by the vial labeler of FIG. 1.

FIGS. 1-3 illustrates an apparatus 10 for applying a label 12 to a vial 14, such as a medicament vial. In various embodiments of the invention, the apparatus 10 may be a vial labeler 10 and may be configured to apply the label 12 to an irregularly shaped or non-cylindrically-shaped vial in a controlled manner such that the label 12 is properly centered and oriented on the vial 14 as desired for particular applications. As illustrated in FIG. 4, the label 12 may have an adhesive side 16, and a non-adhesive side 18, onto which prescription information may be printed. The label 12 may further comprise a leading edge 20 and a trailing edge 22.

Figure 5:
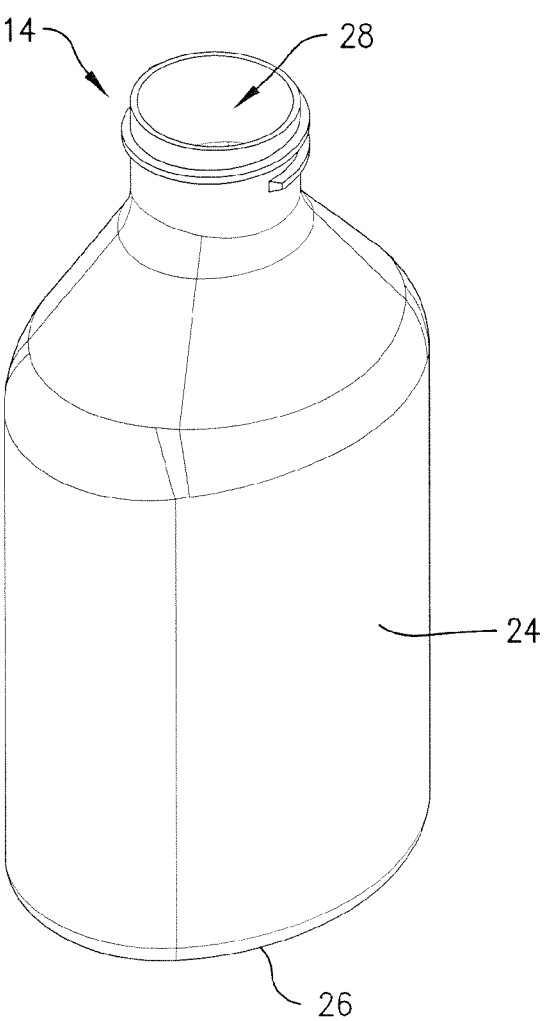
FIG. 5 is a perspective view of the vial to be labeled by the vial labeler of FIG. 1.

As illustrated in FIG. 5, the vial 14 may have an outer face 24 and a base portion 26, and the outer face 24 may form a top opening 28 opposite the base portion 26. The outer face 24 may comprise various curves, indentations, corners, etc. and may have any shape. Specifically, the vial 14 may have a rectangular cross-section, an oval cross-section, or any irregular, non-circular cross-section. However, a cylindrically-shaped vial may also be used, particularly if the cylindrically-shaped vial has any specific indicia or designs such that the label 12 must be placed in a particular position or orientation on the vial 14 in respect to the indicia or designs. Various components of the vial labeler 10 may be configured for particularly shaped vials, however vials of varying shapes and sizes may be labeled by the vial labeler 10 without departing from the scope of this invention.

As illustrated in FIGS. 1-3, the vial labeler 10 may include a label dispenser 30 for printing and dispensing the label 12 and a label applicator assembly 32 for applying the label 12 to the vial 14. The label dispenser may print and dispense a plurality of labels one at a time, first dispensing the leading edge 20 and then the trailing edge 22 of the label 12. For example, the label dispenser 30 may operate in the same manner as the dispensing assembly disclosed in U.S. Pat. No. 5,798,020, incorporated herein in its entirety, although other label dispensers may be used. Specifically, the label dispenser 30 may separate a label backing 34 from the label 12 and feed the label 12 out of the label dispenser 30 such that the vial 14 may be placed into contact with the adhesive side 16 of the label 12. Additionally, the label dispenser 30 may be configured to only partially release the label 12, holding onto or retaining the label 12 proximate the trailing edge 22 until the vial 14 makes contact with the label 12, as later discussed herein.

As illustrated in FIGS. 1-3, the label applicator assembly 32 may comprise a vial placement assembly 36, a pushing device 38, and a labeling gate 40. Furthermore, the label applicator assembly may comprise a track 42, a receiving surface 44, a label positioning device 46, a stopper 48, a label dispensed sensor 50, and at least one controller 52. Various components of the label applicator assembly 32 may be added or removed without departing from the scope of the invention.

Figure 6:
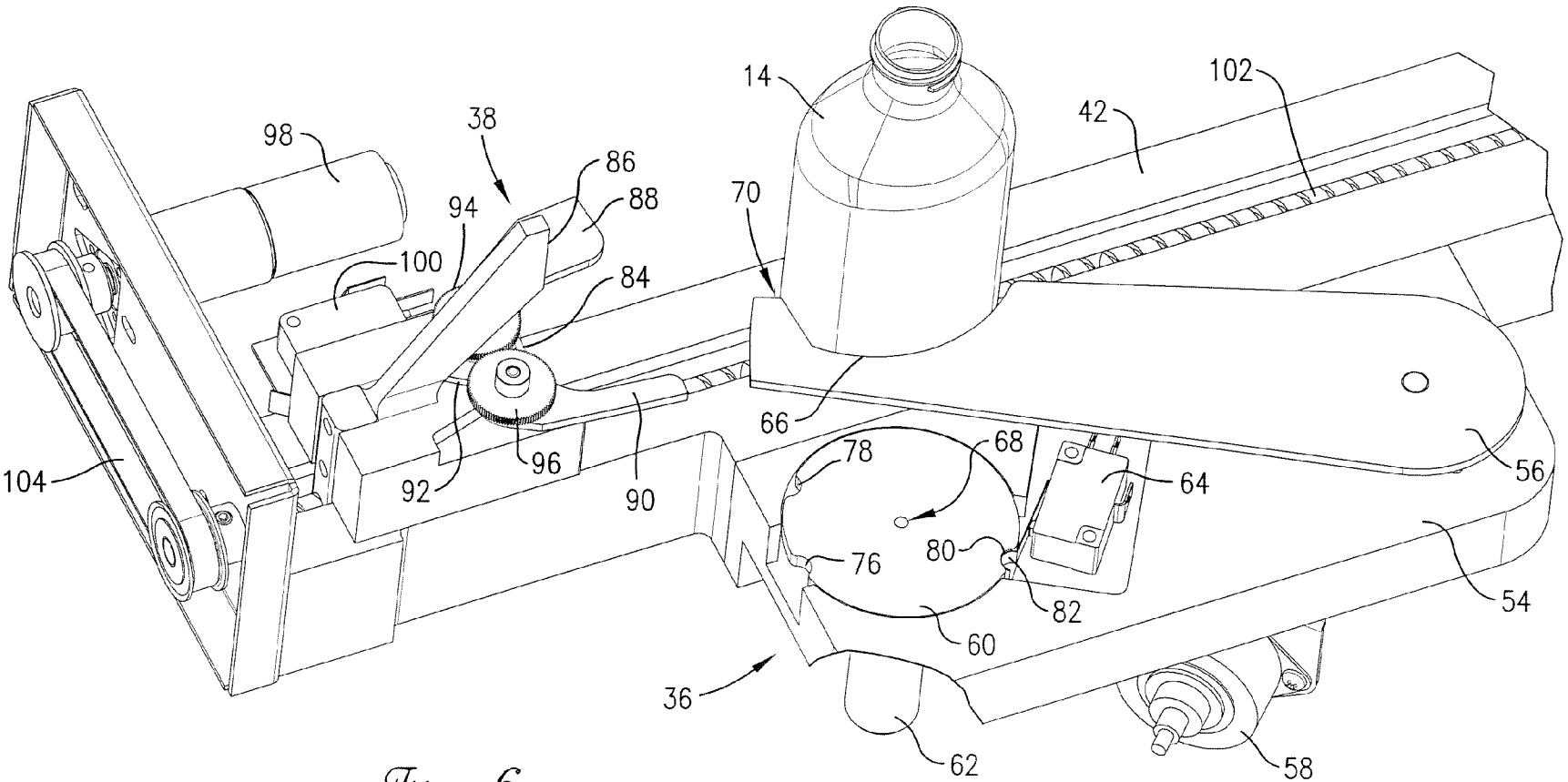
FIG. 6 is a fragmentary perspective view of a vial placement assembly, a pushing device, and the track of the vial labeler with the vial at a second location.
Figure 7:
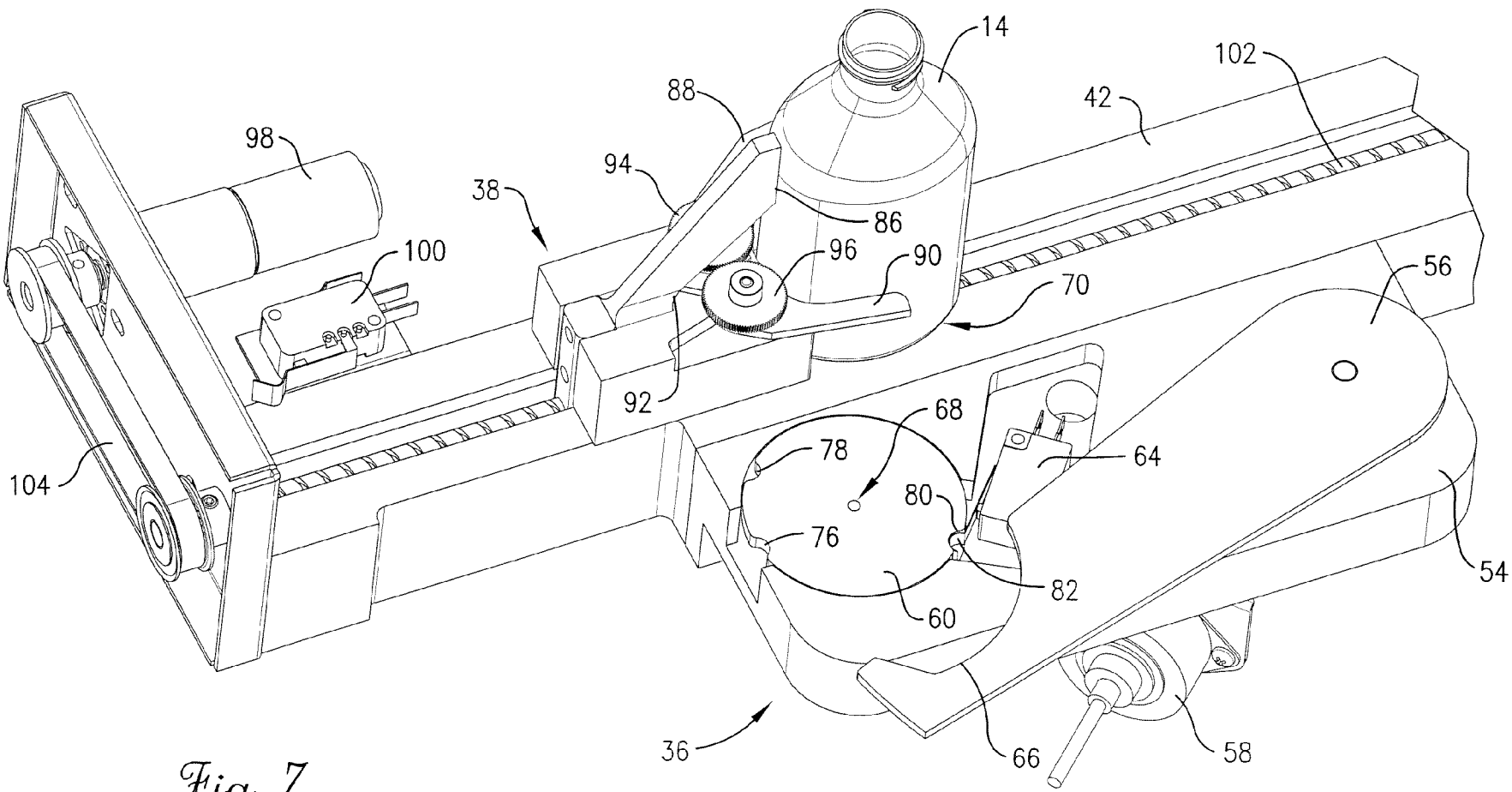
FIG. 7 is a fragmentary perspective view of the vial placement assembly, the pushing device, and the track of the vial labeler with the vial at the second location, and the pushing device contacting the vial.

As illustrated in FIGS. 6-7, the vial placement assembly 36 may comprise a vial placement platform 54, a vial placement arm 56, a vial placement arm actuator 58, a vial orientation turntable 60, a turntable actuator 62, and a turntable location switch 64. The vial placement platform may be attached to or integral with the track and may house or provide a mounting surface for the vial placement arm 56, the vial placement arm actuator 58, the vial orientation turntable 60, the turntable actuator 62, and the turntable location switch 64. The vial placement arm 56 may be pivotally attached to the vial placement platform 54 by an means known in the art. The vial placement arm 56 may comprise a hook portion 66 which may be shaped to substantially conform to at least a portion of the outer face 24 of the vial 14. The vial placement arm actuator 58 may be any actuator known in the art and may be configured to pivot or rotate the arm 56 from a starting location to an ending location, thereby moving the vial 14 resting in the hook portion 66 of the vial placement arm 56 from a first location 68 to a second location 70, as illustrated in FIGS. 6-7. Then the pushing device 38 may move the vial 14 from the second location 70 to a third location 72 (illustrated in FIG. 10) and a fourth location 74 (illustrated in FIG. 12), as later described herein. For reference, the first, second, third, and fourth locations 68-74 are also denoted in FIG. 1.

The vial orientation turntable 60 illustrated in FIGS. 6-7 may be a rotatable platform actuated by the turntable actuator 62 to turn by a specific number of degrees to properly orient the vial 14. In alternative embodiments, the turntable 60 may be a gripper or any device configured to engage and rotate the vial 14 to a proper orientation. The turntable 60 may orient the vial 14 prior to the vial placement arm 56 moving the vial 14 from the first location 68 to the second location 70. The number of degrees by which the turntable 60 must rotate in order to position the vial 14 in a desired orientation may depend on a starting orientation of the vial 14. The starting orientation of the vial 14 may be known or determined by the controller 52 and/or determined by various sensors.

In one embodiment of the invention, best illustrated in FIG. 6, the turntable 60 may include at least two grooves 76,78,80 along its peripheral edge, and the turntable location switch 64 may have a tab portion 82 which may rest within at least one of the grooves 76-80. When the turntable 60 is actuated to rotate, the rotation may stop when the tab portion 82 of the turntable location switch 64 encounters another of the grooves 76-80. The turntable location switch 64 may also be operable to monitor which of the grooves 76-80 its tab portion 82 is located in. One of the grooves may be designated a home position groove 76, and the turntable location switch 64 may notify the controller 52 when the turntable 60 is in the home position groove 76 and therefore ready to receive the vial 14.

For example, a robotic arm (not shown) of an automated medicament dispensing system (not shown) as known in the art may position the vial 14 on the turntable 60 in either a first starting orientation or a second starting orientation. If the controller 52 is notified that the vial 14 is in the first starting orientation, it may command the turntable actuator 62 to rotate clockwise until it reaches a first groove 78. The first groove 78 may be, for example, located at 30 degrees from the home position groove 76. If the controller 52 is notified that the vial 14 is in the second starting orientation, it may command the turntable actuator 62 to rotate clockwise, passing the first groove 78, and continuing until it reaches a second groove 80. The second groove 80 may be, for example, located at 210 degrees from the home position groove 76. Once the vial 14 is moved away from the turntable 60, from the first location 68 to the second location 70, the controller 52 may command the turntable actuator 62 to rotate the turntable 60 back to the home position groove 76 in preparation to receive another vial.

As illustrated in FIGS. 2 and 6-7, the pushing device 38 may comprise a lower vial contact portion 84, an upper vial contact portion 86, two positioning arms 88,90, at least one positioning arm biasing spring 92, gears 94,96, a pushing device actuator 98, and a home position sensor 100. The lower vial contact portion 84 may be shaped to conform to at least a portion of the vial 14. For example, the lower vial contact portion 84 may be curved to conform to a portion of the outer face 24 of the vial 14. Alternatively, the lower vial contact portion 84 may comprise a protrusion (not shown) shaped and positioned to at least partially conform with a recessed portion of the outer surface of the vial 14. The upper vial contact portion 86 may be of any shape, and is configured to provide support to at least a portion of the vial 14 proximate the top opening 28 of the vial 14 to prevent the vial 14 from tipping backwards as the pushing device 38 urges the vial 14 forward.

The two positioning arms 88,90 of the pushing device 38 may be positioned proximate either side of the track 42 and configured to sandwich the vial 14 at a point between the base portion 26 and the top opening 28 of the vial 14. The positioning arms 88,90 may keep the vial 14 centered on the track 42 and prevent the vial 14 from falling off of side edges of the track 42. For example, a first positioning arm 88 may be located to the left of the vial 14 and a second positioning arm 90 may be located to the right of the vial 14. The positioning arms 88,90 may be cooperatively pivotal in opposite directions from each other away from the vial 14. The at least one positioning arm biasing spring 92, such as a torsion spring, may bias the arms 88,90 in a configuration to sandwich the vial 14. And the gears 94,96 may be fixedly attached to or integral with the corresponding positioning arm 88,90 and may have interlocking teeth such that when the first arm 88 is pivoted away from the vial 14, the second arm 90 is also pivoted away from the vial 14 in the opposite direction.

The pushing device actuator 98 may be any actuator for moving the pushing device 38 from the second location 70 to the third location 72 along the track 42. Specifically, the pushing device actuator 98 may cause the pushing device 38 to push the vial 14 to the third location 72, where the vial 14 contacts the adhesive side 16 of the label 12, and then to the fourth location 74, on the receiving surface 44 and past the labeling gate 40. The pushing device actuator 98 may comprise a motor, circuitry, etc., and may rotate a lead screw 102 to move the pushing device 38 along the track 42. For example, the pushing device actuator 98 may rotate the lead screw 102 via a belt 104, as illustrated in FIGS. 2 and 6. Alternatively, the pushing device 38 may be moved laterally along the track 42 via actuation of a conveyor-type belt (not shown) or any other means known in the art for moving an object laterally forward and aft.

The home position sensor 100 may be a switch proximate a starting position or "home" position of the pushing device 38. When the pushing device is in the home position, it is ready for receiving the vial 14 on the track 42 to be pushed toward the label 12. When in contact with the pushing device 38, the home position sensor 100 may signal to the controller 52 that the pushing device 38 is in the home position. For example, if the pushing device 38 is proximate the third location 72, it is not desirable for the vial placement arm 56 to move the vial 14 onto the track 42. Therefore, the controller 52 may be configured to only allow the vial placement arm 56 to move the vial 14 onto the track 42 when the home position sensor 100 has indicated that the pushing device 38 is in the home position. The home position sensor 100 may be mechanical, optical, or any other type of sensor operable to notify the controller 52 that the pushing device 38 is in the home position.

Figure 8:
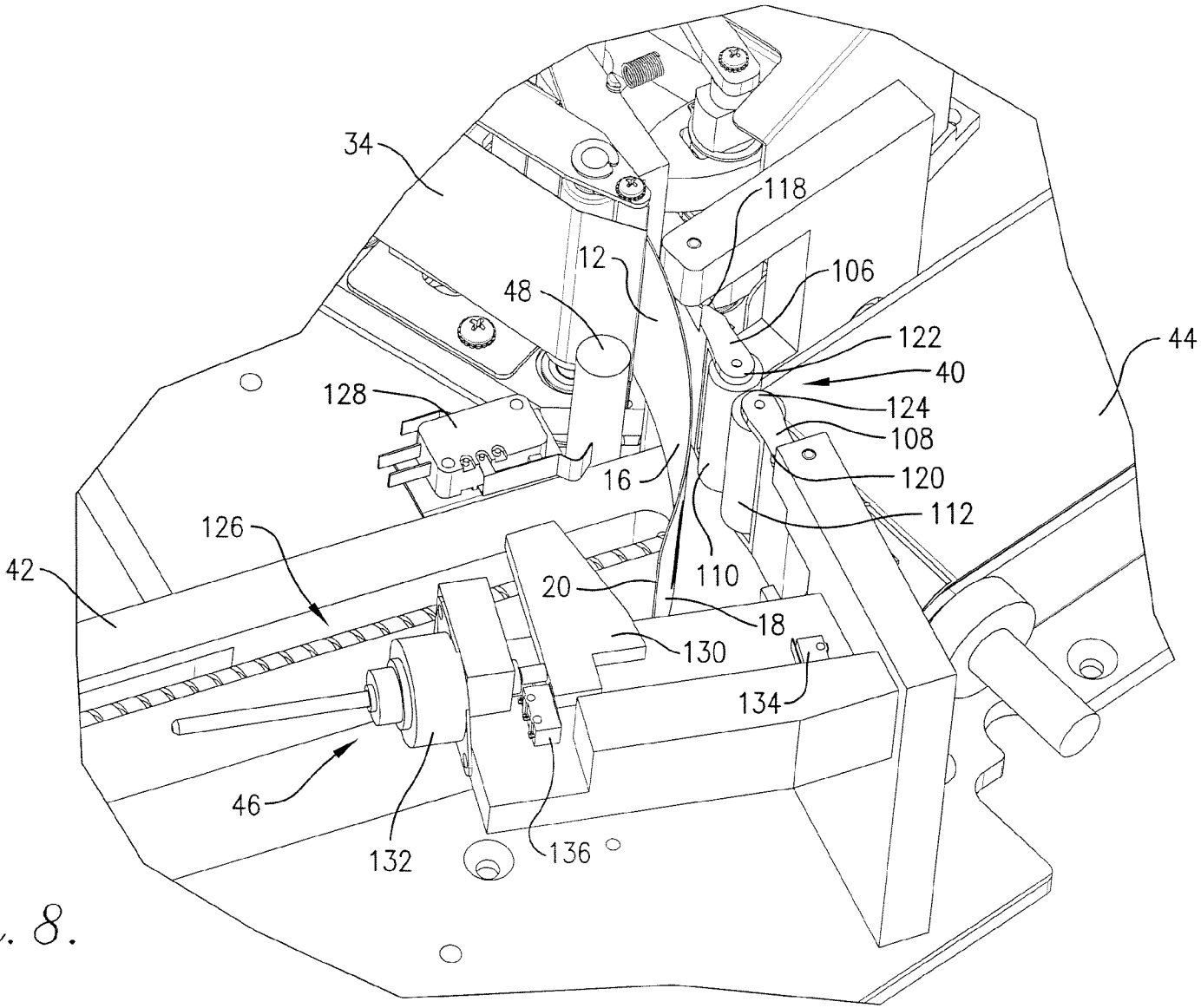
FIG. 8 is a fragmentary perspective view of a labeling gate of the vial labeler.
Figure 9:
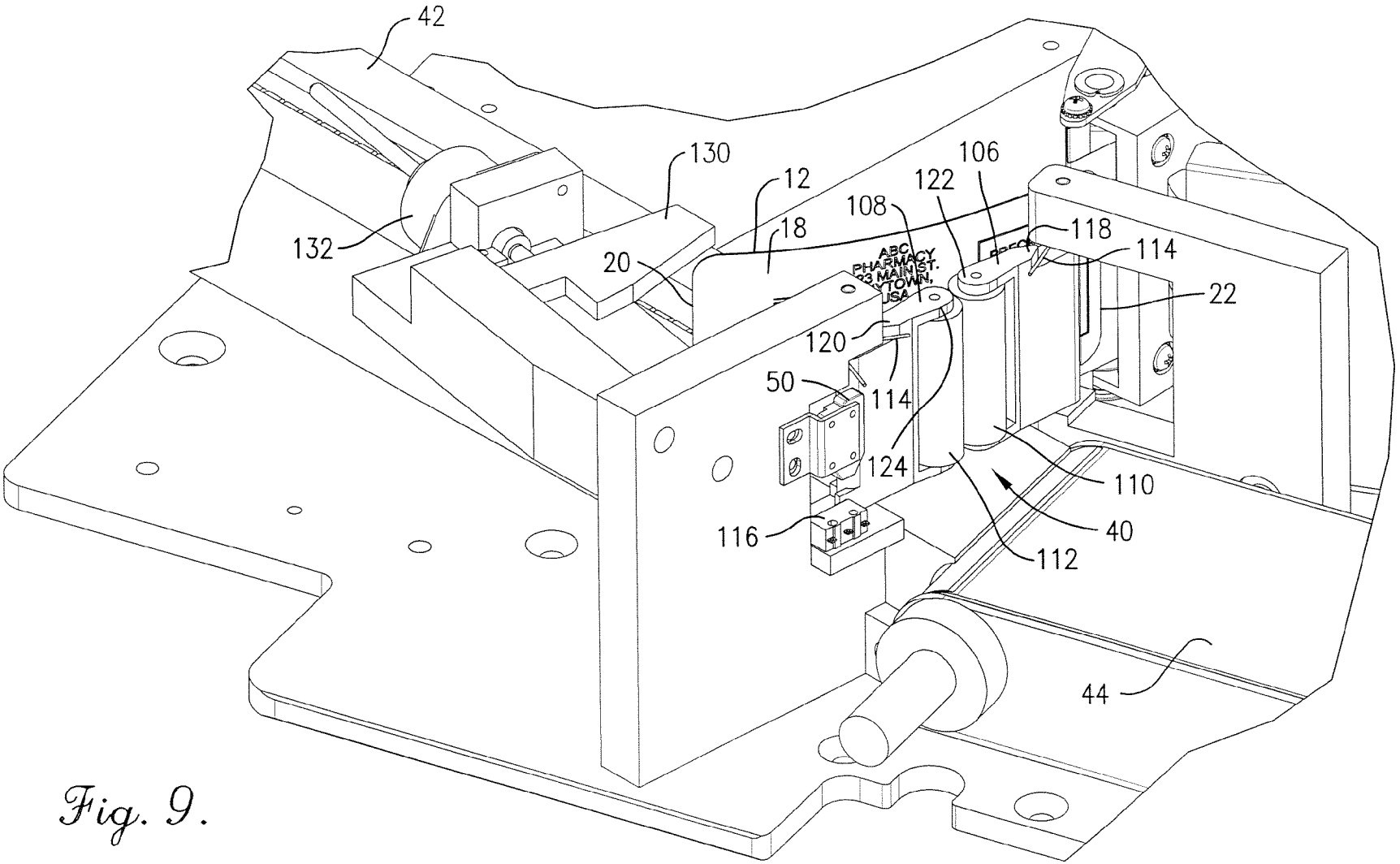
FIG. 9 is a fragmentary perspective view of a label-release switch of the vial labeler.

The labeling gate 40, illustrated in FIGS. 8-9, may comprise one or more label smoothing arms 106,108, such as a first label smoothing arm 106 having a first label smoothing roller 110 and a second label smoothing arm 108 having a second label smoothing roller 112, as well as at least one label smoothing arm biasing spring 114 and a label release switch 116. The labeling gate 40 may be positioned such that, when the label dispenser 30 dispenses the label 12, the non-adhesive side 18 of the label 12 faces the labeling gate 40. The label smoothing arms 106,108 may be pivotally attached to fixed structure of the vial labeler 10 approximately between the third location 72 and the fourth location 74. The label smoothing arms 106,108 may each have a pivotally attached end 118,120 and a non-pivotally attached end 122,124, with the label smoothing rollers 110,112 rotatably attached to the non-pivotally attached ends 122,124. The pivotally attached ends 118,120 may each be positioned outward of or proximate outer edges of the track 42 and/or receiving surface 44, with the non-pivotally attached ends 122,124 biased to be located slightly above the track 42 and/or receiving surface 44 proximate a center of the track 42 and/or receiving surface 44.

The label smoothing arms 106,108 may be operable to independently pivot in opposing directions away from each other when the vial 14 is pushed into the adhesive side 16 of the label 12. The label smoothing arms 106,108 may be normally biased by the label smoothing arm biasing spring 114, such as a torsion spring, in a "gate closed" position, and pressure by the vial 14 may push the label smoothing arms 106,108 outward in a motion similar to opening double doors. The label smoothing arms 106,108 and/or the label smoothing rollers 110,112 may be biased by the label smoothing arm biasing spring 114 to provide pressure against the non-adhesive side 18 of the label 12 as the vial 14 is pushed from the third position 72 to the fourth position 74. The label-smoothing rollers 110,112 may rotate freely when acted upon, such that they may roll against the non-adhesive side 18 of the label 12 when force is applied to the label-smoothing rollers 110, 112 by the vial 14. Therefore the forward motion of the vial 14 received by the pushing device 38 may act on the label smoothing arms 106,108, causing them to pivot outward, and the label smoothing rollers 110,112, causing them to rotate, thereby smoothing the non-adhesive side 18 of the label 12 and applying pressure needed to cause the label 12 to adhere to the vial 14.

The label release switch 116 may be any switch known in the art for sensing a particular movement and sending a signal, such as an electrical signal, corresponding to the movement. The label release switch 116 may be activated by the pivoting motion of at least one of the label smoothing arms 106,108 to send a signal to the controller 52, so that the controller 52 may send a signal to the label dispenser 30 commanding the label 12 to be fully dispensed. For example, to maintain the label 12 in a proper position to receive the vial 14, the label dispenser 30 may dispense a majority of the label 12, but wait to release a portion of the label 12 proximate the trailing edge 22 until the vial 12 begins to push into the labeling gate 40. For example, a portion of the backing 34 may not be removed or "taken up" enough to separate the backing 34 from the portion of the label 12 proximate the trailing edge 22 until the label release switch 116 is activated. However, note that other methods and means of holding the label 12 in a proper position and/or orientation may be used without departing from the scope of this invention.

The track 42 may be of any length and configuration for allowing the vial 14 to be positioned and pushed thereon into the adhesive side 16 of the label 12. In one embodiment, the track 42 may present a slot 126 through which a portion of the pushing device 38 may extend to connect with the lead screw 102, a conveyor belt, or any other actuation means for moving the pushing device 38 forward and aft along the track 42. The track 42 may further comprise a transport limit switch 128, which may control how far along the track 42 the pushing device 38 may slide and/or at what point to change the direction that the pushing device 38 is moving, to move the pushing device 38 back to its home position. The track 42 may be wide enough to allow the base portion 26 of the vial 14 to fit thereon. In various embodiments, the track 42 may contain various raised portions (not shown) to assist in positioning and guiding the vial 14 down the track 42 in the desired orientation. The end of the track 42 proximate the third location 72 may be level with and be substantially adjacent to an end of the receiving surface 44. Specifically, the third location 72 may be on the track 42 and the fourth location 74 may be on the receiving surface 44. Note that while the track 42 is illustrated as being positioned at an angle with respect to the receiving surface 44, the track 42 and the receiving surface 44 may be aligned with each other along a single axis without departing from the scope of the invention.

Figure 12:
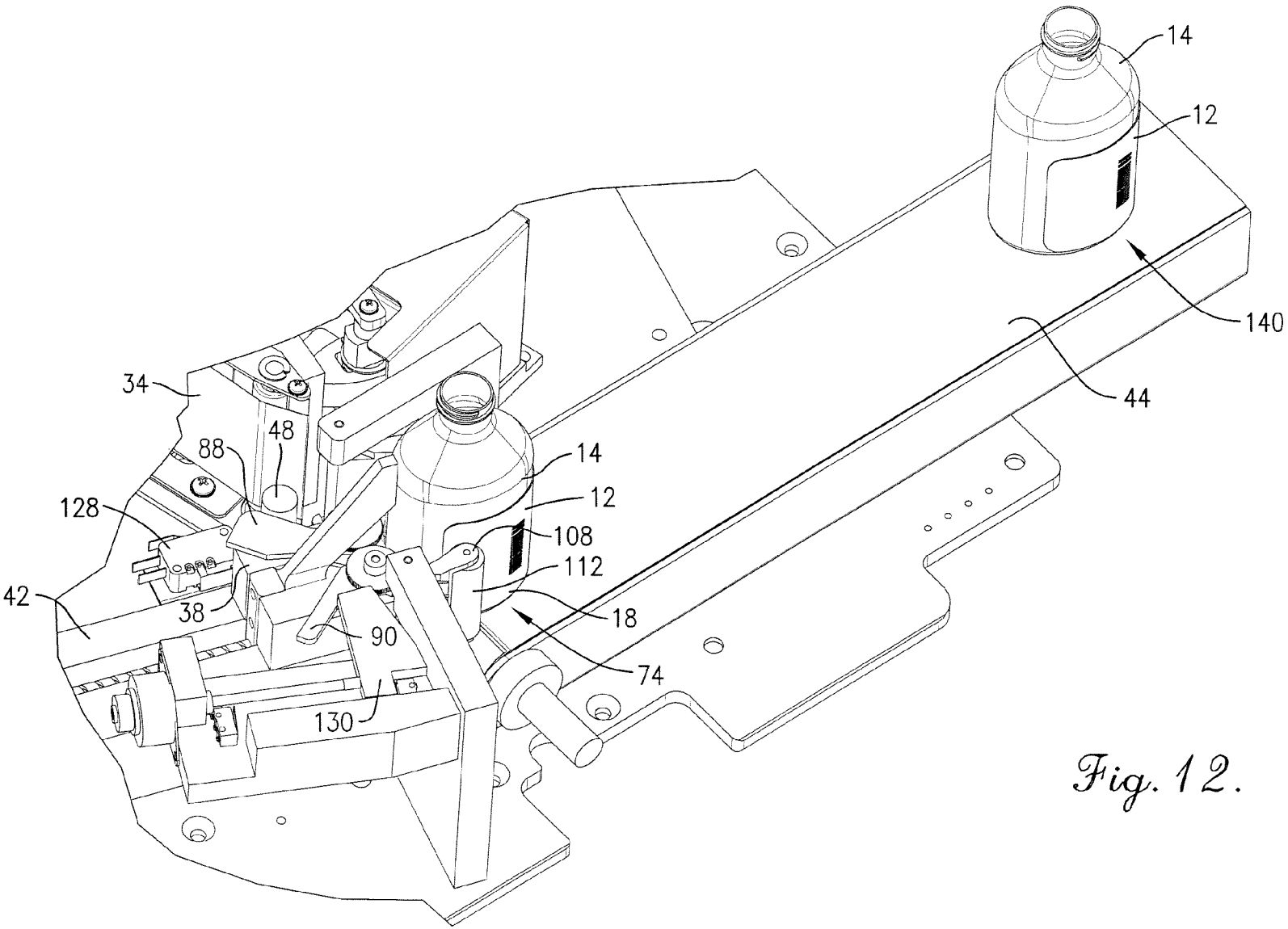
FIG. 12 is a fragmentary perspective view of the vial labeler, a receiving surface, the pushing device, and the labeling gate, and illustrates the vial at a fourth location and again at a fifth location on the receiving surface.

The receiving surface 44, as illustrated in FIGS. 1-2, and 12, may be positioned and configured to receive the vial 14 once its label 12 has been applied. In one embodiment, the receiving surface 44 may be any type of conveyor, such as a conveyor belt, positioned adjacent the track 42 and proximate the labeling gate 40. As a conveyor, the receiving surface 44 may be actuated by any actuator known in the art. However, the receiving surface 44 may alternatively be a fixed surface or any apparatus for delivering the vial 14 to a pharmacist or other individual, or for delivering the vial 14 to another portion of the automated medicament dispensing system (not shown).

As illustrated in FIG. 8, the label positioning device 46 may comprise a label positioning wedge 130, a label positioning actuator 132, and at least one label positioning stop switch 134,136. The label positioning device 46 may be configured to straighten out or flatten the label 12 when it is curling, as may happen when the labels are stored and dispensed off of a spool (not shown) within the label dispenser 30. The label positioning wedge 130 may be of any shape or configuration for substantially flattening the label 12, but may preferably taper along a side facing the label 12. The label positioning wedge 130 may be positioned at a starting position a small distance away from a proper or desired position of the leading edge 20 of the label 12 and be actuated by the label positioning actuator 132, after the label 12 has been dispensed (or partially dispensed), to move toward the adhesive side 16 of the label 12 proximate the leading edge 20 of the label 12.

The at least one label positioning stop switch 134,136 may comprise a first switch 134 that may be activated when the label positioning wedge 130 has been actuated to the proper position for flattening the label 12, thereby signaling the label positioning actuator 132 to stop, and a second switch 136, that may be activated when the label positioning wedge 130 is in the starting position. However, in some embodiments of the invention, one or both of the label positioning stop switches 134,136 may not be required. Once the vial 14 is at the fourth location 74, the pushing device 38 is in the home position, and/or the label release switch 116 has been activated, the label positioning wedge 130 may be activated to move back to its starting position.

Figure 11:
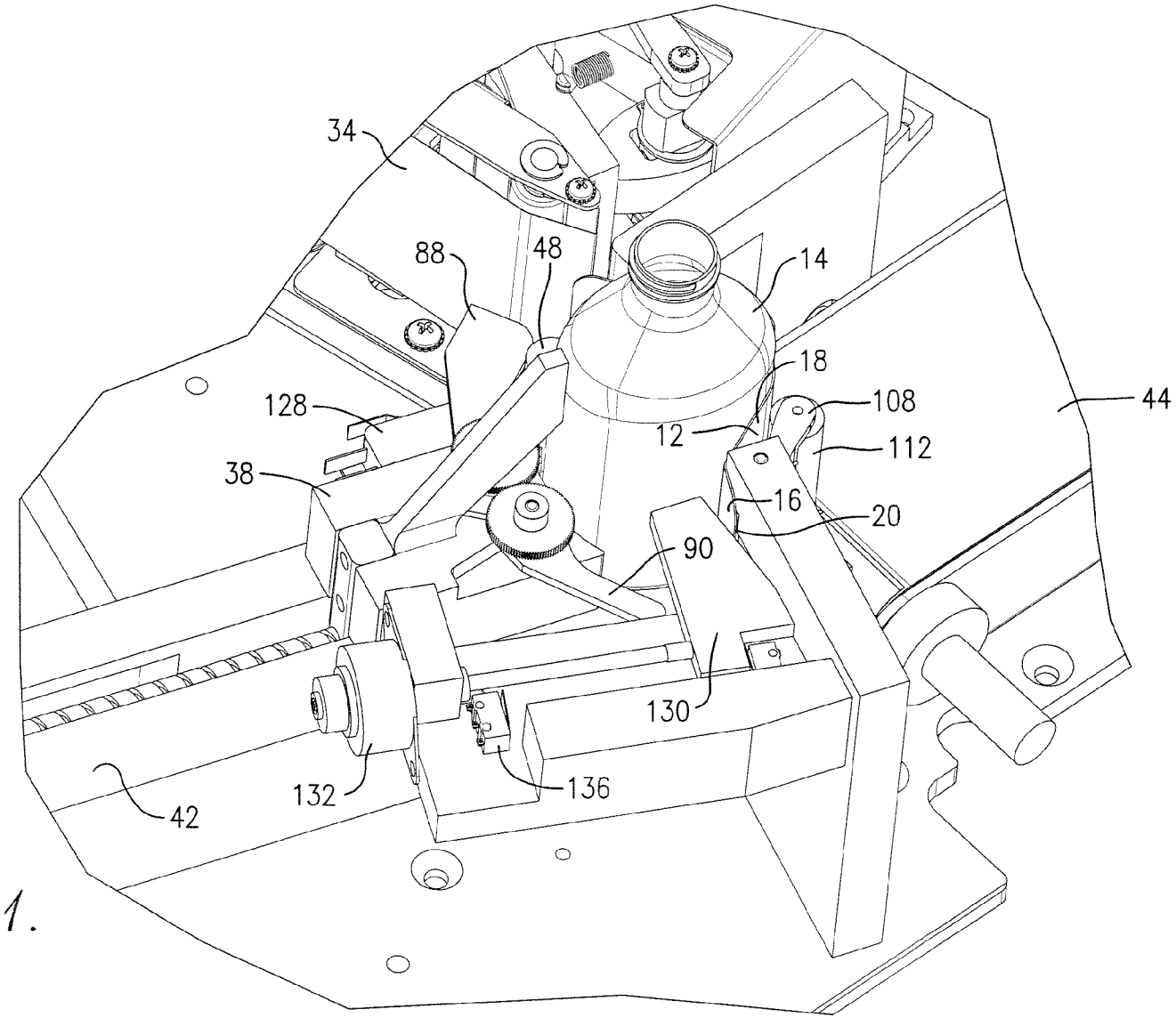
FIG. 11 is a fragmentary perspective view of the vial labeler, track, and pushing device, and illustrates a labeling gate smoothing the label onto the vial.

As illustrated in FIGS. 8 and 11-12, the stopper 48 may be a vertically-positioned post, or any fixed solid structure positioned proximate the labeling gate 40 such that the label dispenser 30 dispenses labels between the stopper 48 and the labeling gate 40, with the adhesive side 16 facing the stopper 48. The stopper 48 may be positioned such that at least one of the positioning arms 88,90 may contact the stopper 48 as the pushing device 38 approaches the third location 72. For example, as the first positioning arm 88 contacts the stopper 48, and the pushing device 38 continues to move forward, both of the pushing arms 88,90 may be caused to pivot away from each other, thereby releasing the vial 14.

The label dispensed sensor 50, illustrated in FIG. 9, may be an optical sensor for determining if the label 12 has been dispensed and is in the proper position for the pushing device 38 to bring the vial 14 into contact with the adhesive side 16 of the label 12. The label dispensed sensor 50 may be located proximate a desired location of the leading edge 20 of the label 12 when the label positioning wedge 130 has been extended to flatten the label 12.

As illustrated in FIG. 3, the at least one controller 52 may comprise any number or combination of processors, controllers, integrated circuits, programmable logic devices, or other control devices and resident or external memory for storing data and other information accessed and/or generated by the vial labeler 10. The controller 52 may be coupled with the label dispenser 30, the vial placement assembly 36, the pushing device 38, the labeling gate 40, the track 42, the receiving surface 44, the label positioning device 46, the label dispensed sensor 50, and other switches, sensors, and components through wired or wireless connections, such as a data bus 138, to enable information to be exchanged between the various components. The controller 52 may be operable to control actuation and timing of the methods described herein. For example, the controller 52 may send command signals to the various actuators of the vial labeler 10 depending on timing and sequencing programmed into the controller, and/or the status of any or all of the various vial labeler 10 components. Additionally, the controller 52 may be configured for receiving status signals from various switches and sensors of the vial labeler 10.

Control of the vial labeler 10 described herein may be accomplished with hardware, software, firmware, or a combination thereof. For example, the controller 52 may be integral with hardware and/or software used to control an automated medicament dispensing apparatus. The controller 52 and computer programs described herein are merely examples of computer equipment and programs that may be used to implement the present invention and may be replaced with or supplemented with other controllers and computer programs without departing from the scope of the present invention. The features of the controller 52 may be implemented in a stand-alone device, which is then interfaced to a more traditional automated medicament dispensing system. The control features of the present invention may also be distributed among the components of vial labeler 10. Thus, while certain features are described as residing in the controller 52, the invention is not so limited, and those features may be implemented elsewhere.

The controller 52 may implement a computer program and/or code segments to perform some of the functions and method described herein. The computer program may comprise an ordered listing of executable instructions for implementing logical functions in the controller. The computer program can be embodied in any computer-readable medium for use by or in connection with an instruction execution system, apparatus, or device, and execute the instructions. In the context of this application, a "computer-readable medium" can be any means that can contain, store, communicate, propagate, or transport the program for use by or in connection with the instruction execution system, apparatus, or device. The computer-readable medium can be, for example, but not limited to, an electronic, magnetic, optical, electromagnetic, infrared, or semi-conductor system, apparatus, device or propagation medium. More specific, although not inclusive, examples of the computer-readable medium would include the following: an electrical connection having one or more wires, a portable computer diskette, a random access memory (RAM), a read-only memory (ROM), an erasable, programmable, read-only memory (EPROM or Flash memory), an optical fiber, and a portable compact disk read-only memory (CDROM).

Figure 13:
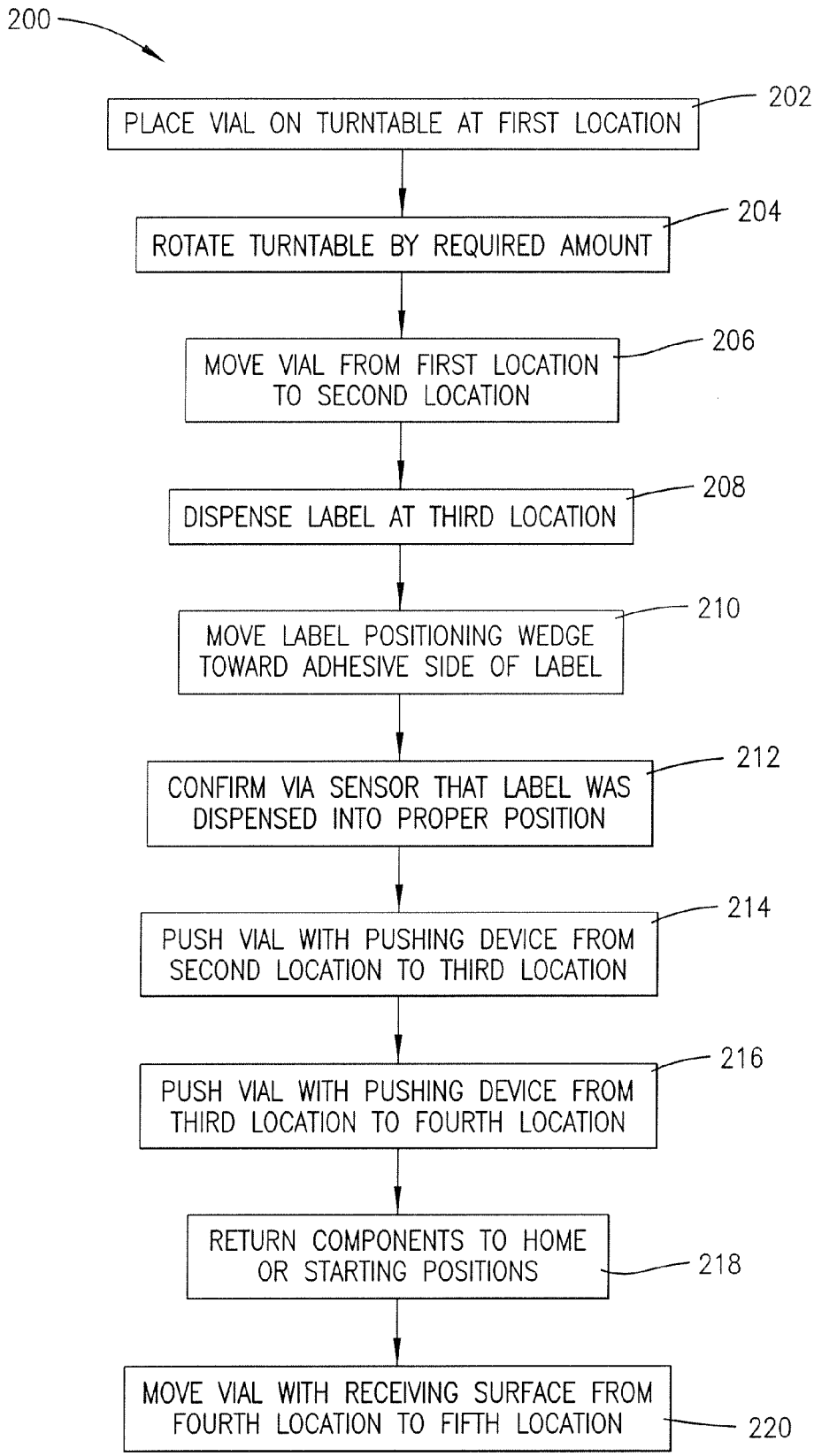
FIG. 13 is a flow chart of a method performed by the vial labeler.

In use, the actuation of the various movable components of the vial labeler 10 may be triggered in response to sensors, a switch, commands from the controller 52, or any combination thereof. As illustrated in FIG. 13, a method 200 of the present invention may comprise placing the vial 14 on the turntable 60, as depicted in step 202, and actuating the turntable 60 to rotate a particular amount depending on the starting orientation of the vial 14, as depicted in step 204. Then the vial placement arm 56 may be actuated to pivot, as depicted in step 206, thereby moving the vial 14 from the first location 68 (as in FIGS. 1 -2) to the second location 70 on the track 42 (as in FIGS. 6-7). The label dispenser 30 may dispense the label 12 any time prior to the vial 14 reaching the third position 72, as depicted in step 208. As described above, dispensing the label 12 may involve only partially dispensing the label 12, retaining a portion of the label 12 proximate the trailing edge 22 (as illustrated in FIG. 9) until the label release switch 116 is triggered by at least one of the label smoothing arms 106,108. The label 12 may be fully dispensed once the label release switch 11 6 is triggered. Additionally, the label positioning wedge 130 may be actuated to press against the adhesive side 16 of the label 12 to prevent the label 12 from curling, as depicted in step 210 and FIGS. 10-12.

Figure 10:
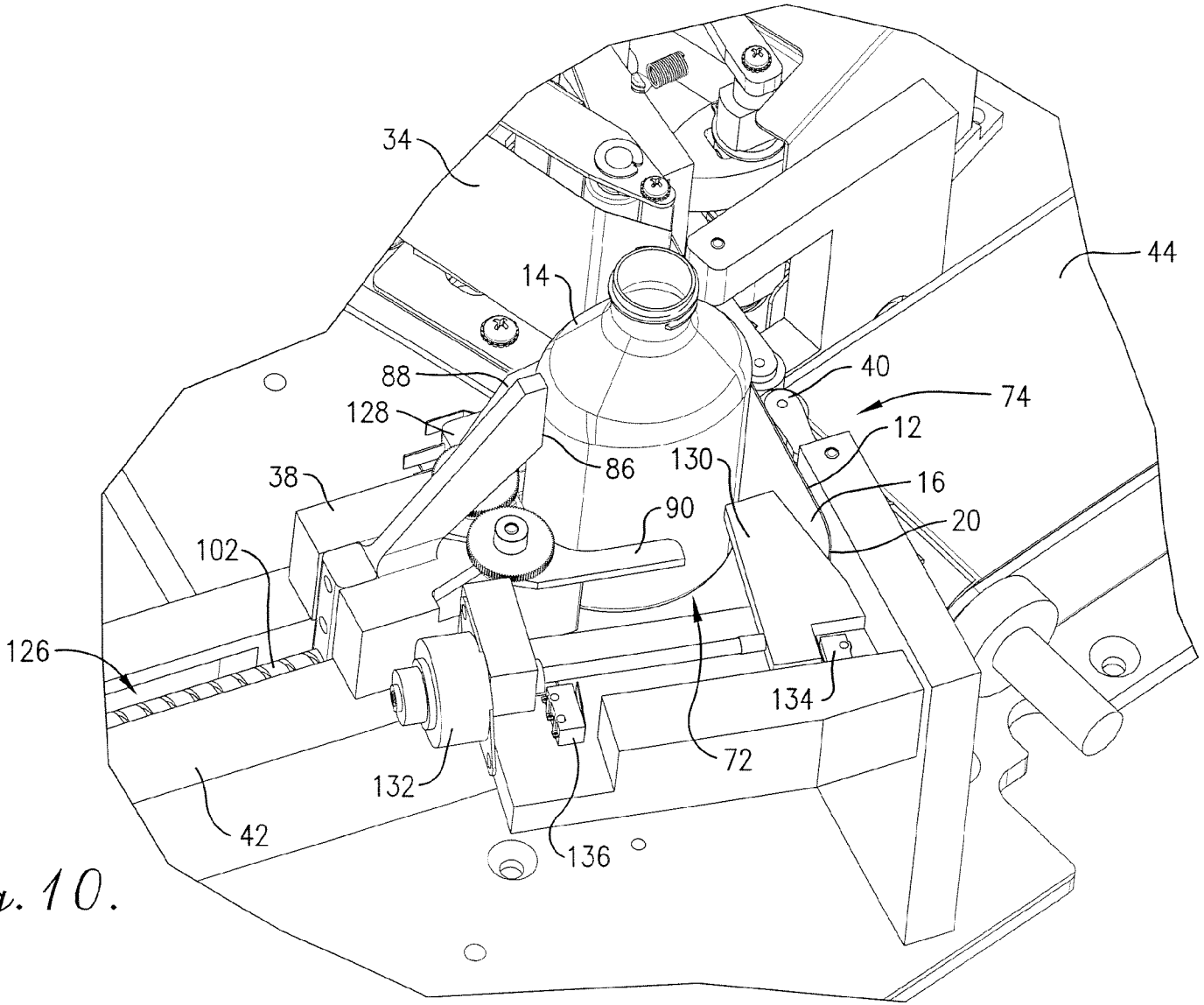
FIG. 10 is a fragmentary perspective view of the vial labeler, track, and pushing device, and illustrates the vial at a third location.

Once the label dispensed sensor 50 verifies that the label 12 is properly positioned, as in step 212, the pushing device 38 may be actuated to move forward, thereby pushing the vial 14 from the second location 70, down the track 42, to the third location 72, as depicted in step 214 and FIGS. 6-7, and 10. At the third location 72, the vial 14 may contact the adhesive side 16 of the label 12. Additionally, at least one of the positioning arms 88,90 may be engaged by the stopper 48 at or proximate the third location 72, as illustrated in FIGS. 11-12. As depicted in step 216, the method may further comprise actuating the pushing device 38 to move from the third location 72 to the fourth location 74, which may be located on the receiving surface 44, as illustrated in FIGS. 10-12. As the vial 14 is pushed from the third location 72 to the fourth location 74, the label 12 is released from the label dispenser 30, the positioning arms 88,90 are rotated or pivoted outward away from the vial 14, and the smoothing arms 106,108 rotate or pivot outward by the force of the pushing device 38 applied through the vial 14 to the smoothing arm rollers 110,112. The smoothing arm rollers 110,112 also rotate against the non-adhesive side 18 of the label 12, as the vial 14 moves from the third location 72 to the fourth location 74.

Once the vial 14 reaches or passes the fourth location 74, the smoothing arms 106,108 may be biased back to their initial position, and each of the actuated components may return to its respective starting or home positions, as depicted in step 218. For example, the vial placement arm 56 may be pivoted back to a starting position immediately after placing the vial 14 in the second location 70, thereby moving out of the way of the pushing device 38, as illustrated in FIG. 7. The pushing device 38 and the label positioning wedge 130 may be returned to their starting or home positions once the vial 14 reaches or passes the fourth location 74, as illustrated in FIG. 1. Additionally, the vial 14 may be moved by the receiving surface 44 to a fifth location 140, as depicted in step 220 and FIG. 12. Then the method may be repeated when each of the components are in their corresponding start or home positions and another vial is placed on the turntable 60.

A cap or lid (not shown), may be secured at the top opening 28 of the vial 14 by a pharmacist or other individuals once it is verified that the contents of the vial 14 correspond with the description printed on the label 12. Alternatively, another apparatus, independent of or integral to the vial labeler 10 may apply the lid to the vial 14 before, during, or after application of the label 12.

Although the invention has been described with reference to the embodiments illustrated in the attached drawings, it is noted that equivalents may be employed and substitutions made herein without departing from the scope of the invention as recited in the claims. For example, the method steps described herein may be carried out in any order. Additionally, steps or components may be added or removed without departing from the scope of the invention. For example, in an alternative embodiment of the invention, the vial placement assembly 36 may be omitted, the vial 14 may be placed directly at the second location 70, and another device, such as an actuator on the pushing device 38, an actuator on the track 42, or an external device may be used to rotate the vial 14 to the desired orientation.

Having thus described an embodiment of the invention, what is claimed as new and desired to be protected by Letters Patent includes the following:

1. An apparatus for applying a label to an outer face of a vial, the apparatus comprising:

a label dispenser for dispensing a label to be applied to the vial; and a pushing device for pushing the vial toward an adhesive side of the label such that the label adheres to the vial without rotating the vial, wherein the pushing device further comprises two positioning arms biased to cooperatively sandwich at least a portion of the outer face of the vial to ensure proper vial orientation and configured to cooperatively pivot away from the vial in opposing directions to release the vial as the vial contacts the label.

2. The apparatus of claim 1, further comprising:

a turntable at a first location configured to rotate the vial from a first orientation to a second orientation prior to the vial contacting the adhesive side of the label.

3. The apparatus of claim 2, further comprising:

a vial placement arm configured to move the vial from the first location to a second location, such that the pushing device may contact the vial at the second location.

4. The apparatus of claim 1, wherein the pushing device is configured to push the vial from a second location to a third location and from the third location to a fourth location, wherein the label dispenser is operable to present the label at the third location with the adhesive side of the label facing the pushing device.

5. The apparatus of claim 3, wherein the vial placement arm has a hook portion and is configured to pivot such that the hook portion moves the vial from the first location to the second location.

6. The apparatus of claim 1, wherein the pushing device comprises portions configured to partially conform to the shape of at least a portion of the outer face of the vial.

7. The apparatus of claim 1, wherein the pushing device further comprises at least one protrusion substantially shaped to partially conform to a recessed portion of the vial.

8. The apparatus of claim 5, wherein the hook portion is configured to partially conform to the shape of at least a portion of the outer face of the vial.

9. The apparatus of claim 4, further comprising two label-smoothing arms positioned between the third location and the fourth location and configured to pivot in opposing directions toward the fourth location when force is applied to the label-smoothing arms by the vial, wherein the label-smoothing arms are configured to smooth the label onto the vial as the vial is pushed from the third location to the fourth location.

10. The apparatus of claim 9, wherein the label-smoothing arms each comprise a label-smoothing roller configured to rotate against a non-adhesive side of the label as the vial is pushed from the third location to the fourth location.

11. The apparatus of claim 1, further comprising a label positioning device configured to be actuated in a direction toward the adhesive side of the label proximate a leading edge of the label, to compensate for any undesired curling of the label.

12. The apparatus of claim 1, further comprising at least one stopper positioned to be engaged by at least one of the positioning arms, forcing the positioning arms to pivot outward away from each other, thereby releasing the vial as the vial is pushed into the adhesive side of the label.

13. The apparatus of claim 4, further comprising a conveyor at the fourth location.

14. The apparatus of claim 9, further comprising a label-release switch operable to sense when the label smoothing arms begin to rotate and to subsequently feed a trailing end of the label out of the label dispenser.

15. The apparatus of claim 3, further comprising a controller and at least one sensor or switch configured to notify the controller of an orientation or location of at least one of the turntable, the vial placement arm, the pushing device, and the label.

16. An apparatus for applying a label to an outer face of a vial, the apparatus comprising:

a turntable at a first location configured to rotate the vial from a first orientation to a second orientation;

a vial placement arm configured to move the vial from the first location to a second location;

a pushing device configured to push the vial from the second location to a third location and from the third location to a fourth location;

a label dispenser operable to dispense at least a portion of a label at the third location such that an adhesive side of the label faces the pushing device; and at least one label-smoothing arm configured to provide pressure to a non-adhesive side of the label when the vial is pressed into the adhesive side of the label.

17. The apparatus of claim 16, wherein the pushing device comprises portions configured to partially conform to the shape of at least a portion of the outer face of the vial.

18. The apparatus of claim 16, wherein the pushing device further comprises two positioning arms biased to cooperatively sandwich at least a portion of the outer face of the vial and configured to cooperatively pivot away from the vial in opposing directions to release the vial at the third location.

19. The apparatus of claim 16, wherein the at least one label-smoothing arm is positioned between the third location and the fourth location, configured to pivot outward when force is applied to the at least one label-smoothing arm by the vial, and comprises at least one label-smoothing roller configured to rotate against the non-adhesive side of the label as the vial is pushed from the third location to the fourth location.

20. The apparatus of claim 16, further comprising a label positioning device configured to be actuated in a direction toward the adhesive side of the label proximate a leading edge of the label prior to the vial contacting the adhesive side of the label, to compensate for any undesired curling of the label.

21. The apparatus of claim 18, further comprising at least one stopper positioned to be engaged by at least one of the positioning arms, forcing the positioning arms to pivot outward away from each other, thereby releasing the vial as the vial is pushed from the third location to the fourth location.

22. The apparatus of claim 16, further comprising a label-release switch operable to sense when the at least one label smoothing arm begins to rotate and to subsequently feed a trailing end of the label out of the label dispenser.

* * * * *